US011403975B2

(12) United States Patent
Apostle et al.

(10) Patent No.: US 11,403,975 B2
(45) Date of Patent: Aug. 2, 2022

(54) OUTDOOR DISPLAY SYSTEM

(71) Applicant: Orbus, LLC, Woodridge, IL (US)

(72) Inventors: James J. Apostle, Shorewood, IL (US); Drew A. Adams, Glenview, IL (US); Dmitri Doubovikov, Vernon Hills, IL (US)

(73) Assignee: Orbus, LLC, Woodridge, IL (US)

( * ) Notice: Subject to any disclaimer, the term of this patent is extended or adjusted under 35 U.S.C. 154(b) by 0 days.

(21) Appl. No.: 16/710,944

(22) Filed: Dec. 11, 2019

(65) Prior Publication Data

US 2021/0183280 A1 Jun. 17, 2021

(51) Int. Cl.
*G09F 15/00* (2006.01)

(52) U.S. Cl.
CPC ..... *G09F 15/0068* (2013.01); *G09F 15/0062* (2013.01)

(58) Field of Classification Search
CPC ..... G09F 15/0056; G09F 15/0062
USPC ..... 40/610, 602
See application file for complete search history.

(56) References Cited

U.S. PATENT DOCUMENTS 3,595,509 A * 7/1971 Gilmoure ..... G09F 15/0062 248/175
4,875,302 A * 10/1989 Noffsinger ..... G09F 15/0062 40/610
5,347,737 A * 9/1994 Theobald, III ..... G09F 15/0062 248/166
5,365,687 A * 11/1994 Sclater ..... G09F 21/04 40/591
6,240,666 B1 * 6/2001 Apel ..... G09F 19/00 40/610
6,244,011 B1 * 6/2001 Esser ..... G09F 15/0056 135/131
6,284,330 B1 * 9/2001 Hermanson ..... A47G 33/06 362/806
6,393,748 B1 * 5/2002 Cooper ..... G09F 7/18 248/165
6,718,669 B1 * 4/2004 Hayes ..... G09F 15/0062 40/603
2002/0088157 A1 * 7/2002 Winterton ..... G09F 15/00 40/610
2006/0174525 A1 * 8/2006 Hughes ..... G09F 15/0025 40/603
2009/0107020 A1 * 4/2009 Aires ..... G09F 15/0025 40/610
2018/0347200 A1 * 12/2018 Hooper ..... E01F 7/025

* cited by examiner

*Primary Examiner* — Gary C Hoge
(74) *Attorney, Agent, or Firm* — Leydig, Voit & Mayer, Ltd.

(57) ABSTRACT

A display system, including a graphic display cover is described that includes an upper support frame configured to support the graphic display cover; a lower support frame configured to widen the graphic display cover; and a base frame configured to stabilize the graphic display cover. The base frame is anchored to the ground at multiple locations about the base frame. The upper support frame, the lower support frame and the base frame are collapsible and transportable.

17 Claims, 13 Drawing Sheets

OUTDOOR DISPLAY SYSTEM

FIELD OF THE DISCLOSURE

The present disclosure is directed to display systems such as billboards and, more particularly, to a temporary outdoor billboard.

BACKGROUND OF THE INVENTION

Outdoor displays, especially of the temporary type, typically include a structural member such as a pole, which is staked to the ground so it remains upright and which is used to support a banner having graphics thereon. Outdoor displays of this type are limited in the amount of visual information they can include and, thus, display, and are typically difficult to see from all directions. Moreover, they are free to move with the wind, which makes it difficult for passersby to easily see the information that is displayed.

Another type of outdoor display is a solid panel or billboard, which can display a lot of information on a two dimensional, rigid surface. This type of display is more permanent in its installation due to its size and weight. Wind loads pushing on the sides of the billboard are also a concern. For these reasons, billboards tend to be installed using foundations on the ground or elaborate structures on top of buildings.

There is a need for portability in outdoor signage. Currently, there is no product that offers the ability to temporarily display graphics or information on a semi-permanent free-standing structure.

BRIEF SUMMARY OF THE DISCLOSURE

The invention provides a display system, including a graphic display cover; an upper support frame configured to support the graphic display cover; a lower support frame configured to widen the graphic display cover; and a base frame configured to stabilize the graphic display cover. The base frame is anchored to the ground at multiple locations about the base frame. The upper support frame, the lower support frame and the base frame are collapsible and transportable.

The invention also provides a method of assembly of an outdoor display, including building a first side portion of a base frame via connecting a first plurality of rods; sliding a first bag support over the first side of the base frame; building a second side portion of the base frame via connecting a second plurality of rods; sliding a second bag support over the second side of the base frame; building a center portion of the base frame including crossbeams; connecting the first side, second side and center portions to form the base frame; building and connecting a lower vertical frame to the base frame; and building and connecting an upper horizontal frame to the lower vertical frame. The base frame is anchored to the ground at multiple locations about the base frame. The upper horizontal frame, the lower vertical frame and the base frame are collapsible and transportable.

BRIEF DESCRIPTION OF THE SEVERAL VIEWS OF THE DRAWING(S)

DETAILED DESCRIPTION OF THE INVENTION

Reference will now be made in detail to specific embodiments or features, examples of which are illustrated in the accompanying drawings. Wherever possible, corresponding or similar reference numbers will be used throughout the drawings to refer to the same or corresponding parts. Moreover, references to various elements described herein, are made collectively or individually when there may be more than one element of the same type. However, such references are merely exemplary in nature. It may be noted that any reference to elements in the singular may also be construed to relate to the plural and vice-versa without limiting the scope of the disclosure to the exact number or type of such elements unless set forth explicitly in the appended claims.

Figure 1:
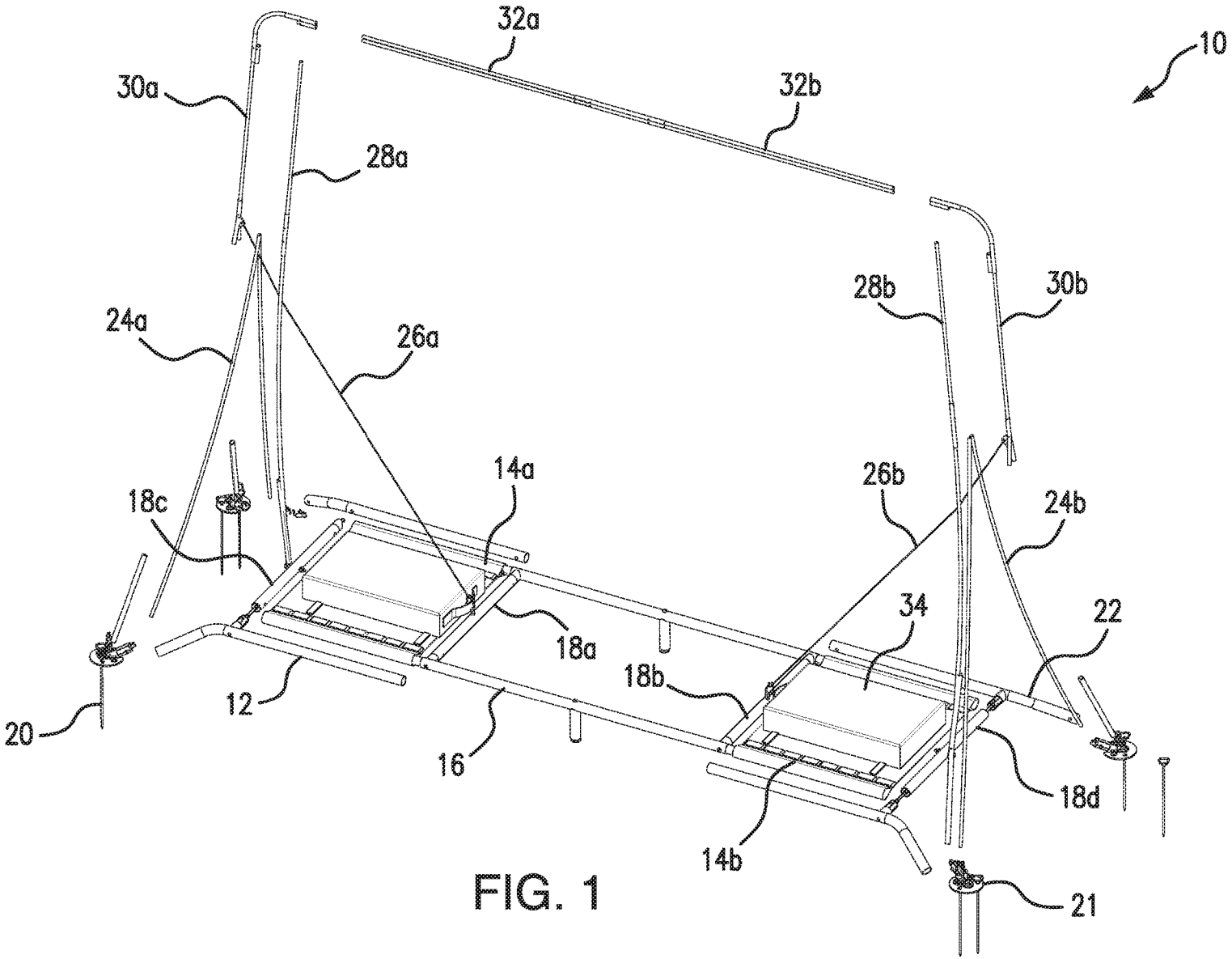
FIG. 1 is a perspective exploded view of a support frame for an outdoor display system according to an embodiment.

Referring now to FIG. 1, there is a tubular support frame 10 for an outdoor display system 44 according to an embodiment. In certain embodiments, the tubular frame 10 includes at least four angled support rods 24*a*, 24*b*, at least two tension lines 26*a*, 26*b*, two vertical L-shaped rods 30*a*, 30*b*, upper rod supports 32*a*, 32*b* may be made of a strong flexible material, such as fiber glass rods. Tubular support frame 10 may comprise a plurality of rods or poles (24*a*, 24*b*, 30*a*, 30*b*, 32*a*, 32*b*). In some embodiments, some of the plurality of rods include a plurality of connectors 17, 19 configured with a press button to be pressed when inserting connectors 17, 19 into, for example, rods 12, 16. The plurality of connectors 17, 19 may comprise zinc plating to protect against corrosion when the frame 10 is used in an outdoor environment. The plurality of rods (24*a*, 24*b*, 30*a*, 30*b*, 32*a*, 32*b*) help contain and hold the shape of the frame 10 and provide flexibility to keep the display system 44 contained within outdoor conditions. The plurality of rods (24*a*, 24*b*, 30*a*, 30*b*, 32*a*, 32*b*) may be made of fiberglass and also securely insert into a stretcher-style base at 38 which in some embodiments comprises aluminum. The plurality of rods (24*a*, 24*b*, 28*a*, 28*b*, 30*a*, 30*b*, 32*a*, 32*b*) are a pivotal component that easily connect and are flexible within the support frame 10 to allow for strength and flexibility under windy conditions. This feature also allows the frame 10 to safely be used outdoors as well. The overall shape of the display system 44 is that of an elongated pyramid such that, when wind loads are applied onto its sides, the resulting wind forces are dissipated by bending or deflection of the various structural members thereof and/or are transferred onto the feet 21 to the ground.

The stretcher-style base at 38 includes anchor holders 14*a*, 14*b*, rods 16, 18*a*, 18*b*, and legs 22 having attached feet 21 for the option to use ground stakes 20 and/or waterproof bags 34 configured to be filled with sand or weights for additional securing and stability of the frame 10 to the ground when being utilized outdoors. Tapered arms 24*a*, 24*b* at base/bottom of frame 10 also allow for strength and stability. The plurality of rods (24*a*, 24*b*, 30*a*, 30*b*, 32*a*, 32*b*) and the lightweight aluminum base at 38 easily break down for ease of portability. In other words, the frame 10 is configured to be collapsible and transportable. Moreover, a footprint, which in the illustrated embodiment has a rectangular shape extending between the four feet 21, is considerably larger than an overall shape of the display 44 contained within the footprint to provide stability. It will be understood that the term "anchor holder" and "bag support" refers herein to the same element(s).

In certain embodiments, the base at 38 comprises a lightweight metal, such as aluminum. Lightweight base 38 provides two areas to place weighted bags 34 as well as optional lighting solution (not shown). The lighting, when used, may be self-contained and include light emitting diodes (LEDs) or other light sources that are disposed on the base 38 and configured to shine light upwards, to illuminate the cover onto which graphics are included. Power to operate the lighting can be provided by a power source such as batteries that are also disposed on the base, or by a power cable. The base 38 can be easily assembled and disassembled.

In certain embodiments, feet 21 may be configured to easily allow for the application of ground stakes 20. The feet 21 will also be pre-assembled with arm tube, ring and clip attached for extra support in graphic attachment.

Figure 2:
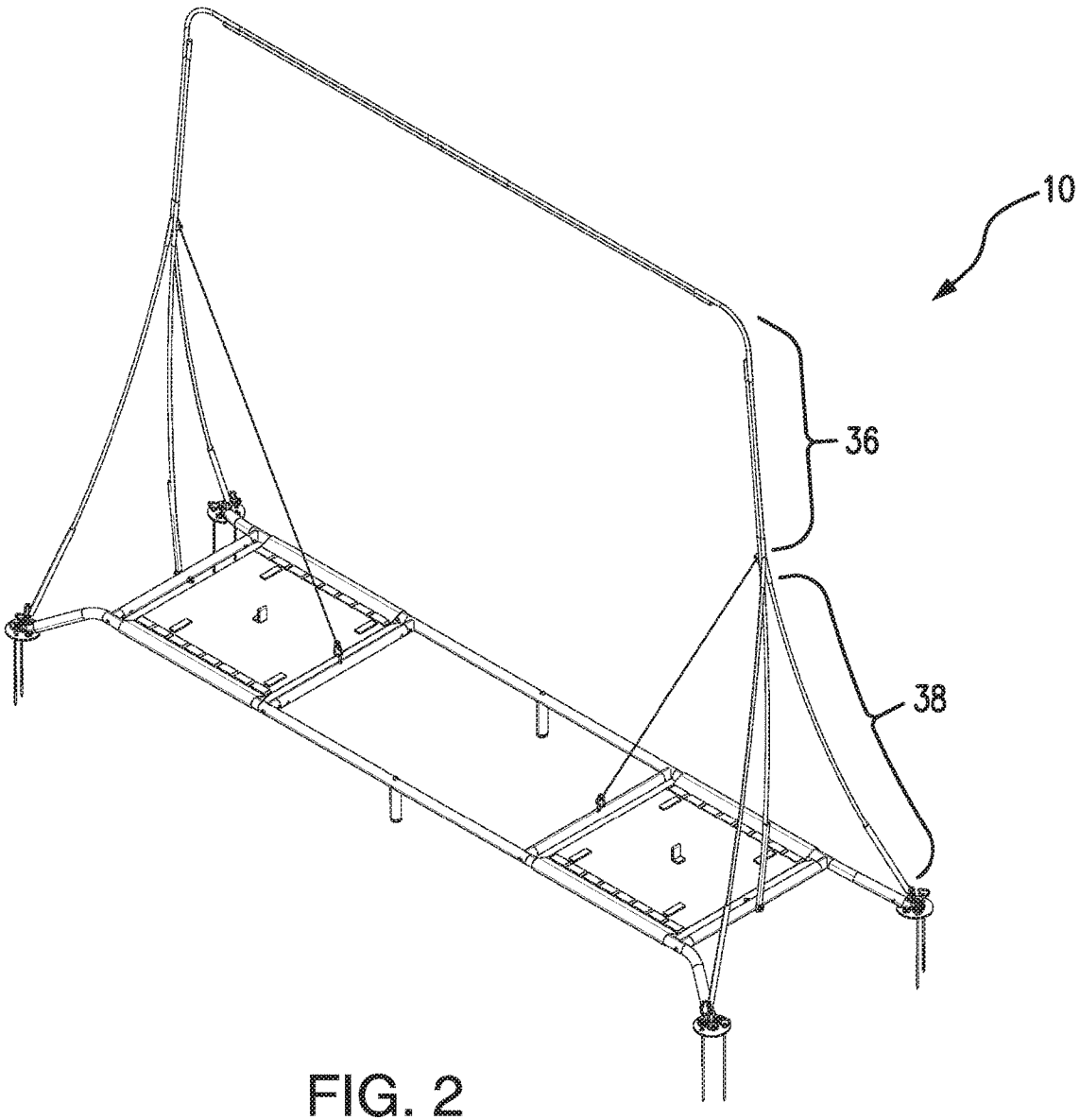
FIG. 2 is an exploded view of the support frame of the outdoor display system according to an embodiment.

Referring now to FIG. 2, there is the support frame 10 of the outdoor display system 44 according to an embodiment. In FIG. 2, frame 10 includes an upper portion 36 and a lower portion 38. In some embodiments, upper portion 36 comprises L-shaped rods 30*a*, 30*b* and connector rods 32*a*, 32*b*. In some embodiments, connector rods 32*a*, 32*b* are configured to connect to one end of rods 30*a*, 30*b*, respectively while another end of rods 30*a*, 30*b* is configured to connect to lower portion 38. In certain embodiments, lower portion 38 comprises Y-shaped rods 24*a*, 24*b*; stretcher-style base rods 12, 16, 18*a*, 18*b*; anchor holders 14*a*, 14*b*; feet 21; legs 22; tension rod 28*a*, 28*b* and tension cords 26*a*, 26*b*.

Figures 3A, 3B:
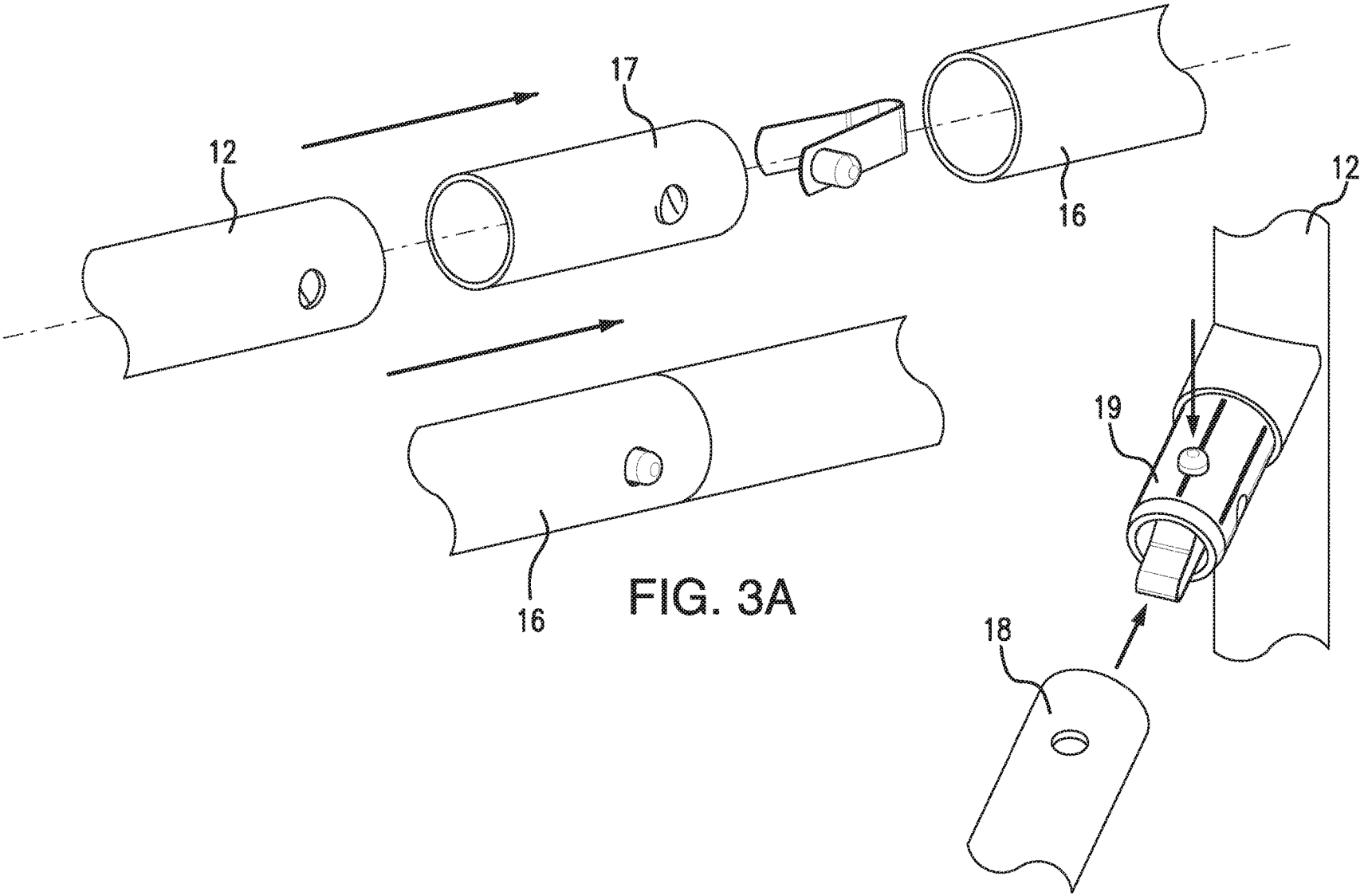
FIG. 3A is a perspective view of a connector for the support frame of the outdoor display system according to an embodiment.
FIG. 3B is a perspective view of another connector for the support frame of the outdoor display system according to an embodiment.

Referring now to FIGS. 3A and 3B, there is a connector 17 for the support frame 10 of the outdoor display system 44 according to an embodiment. In certain embodiments, connector 17 may be a spring loaded catch configured to connect portions of rod 16 to rod 12 or vice versa. In some embodiments, another connector 19 for the support frame 10 of the outdoor display system 44 is configured to connect portions of rod 16 to rods 18*a*, 18*b* via a spring loaded catch as well.

Figure 4A:
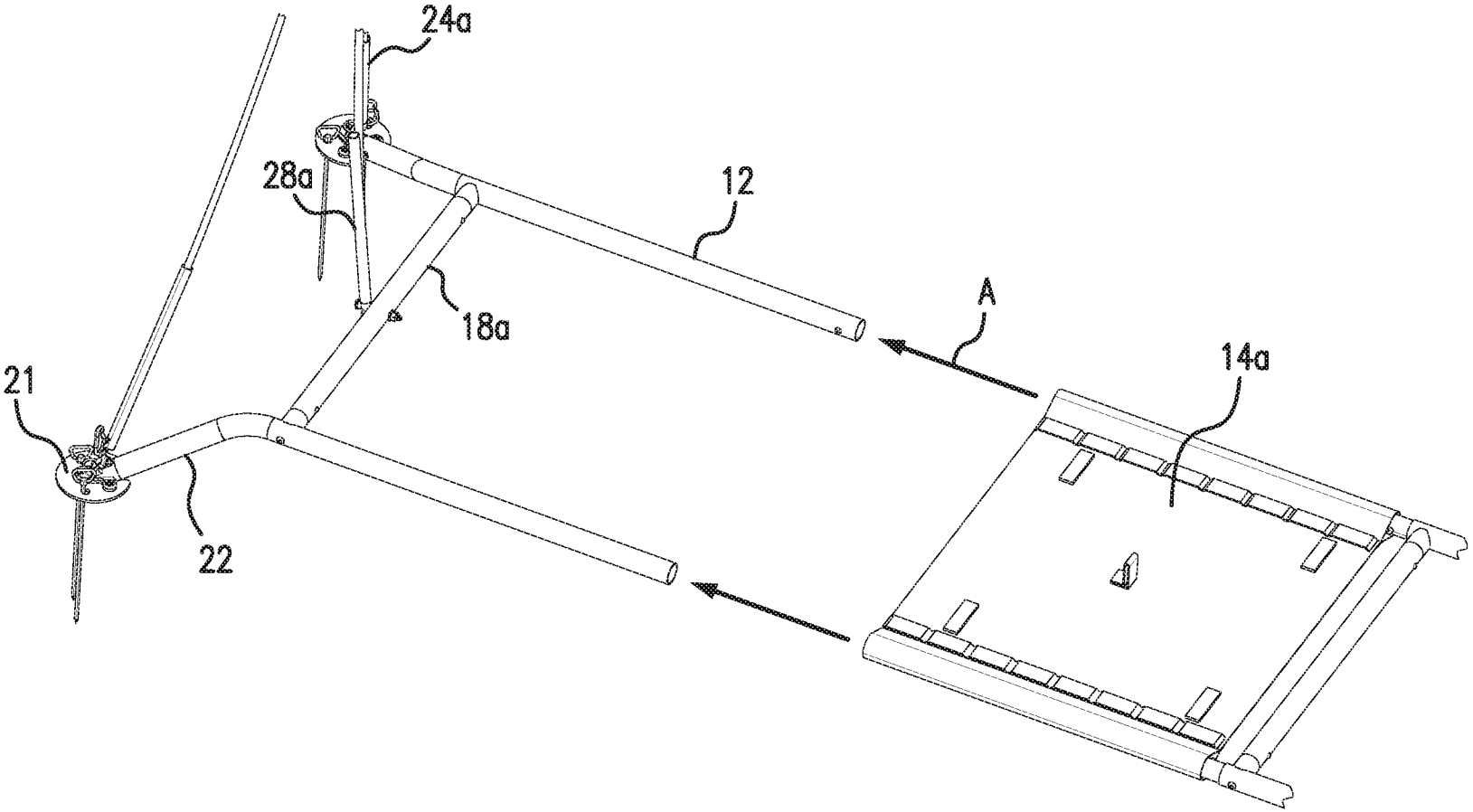
FIG. 4A is a perspective view of a first side of a base frame of the outdoor display system according to an embodiment.
Figure 4B:
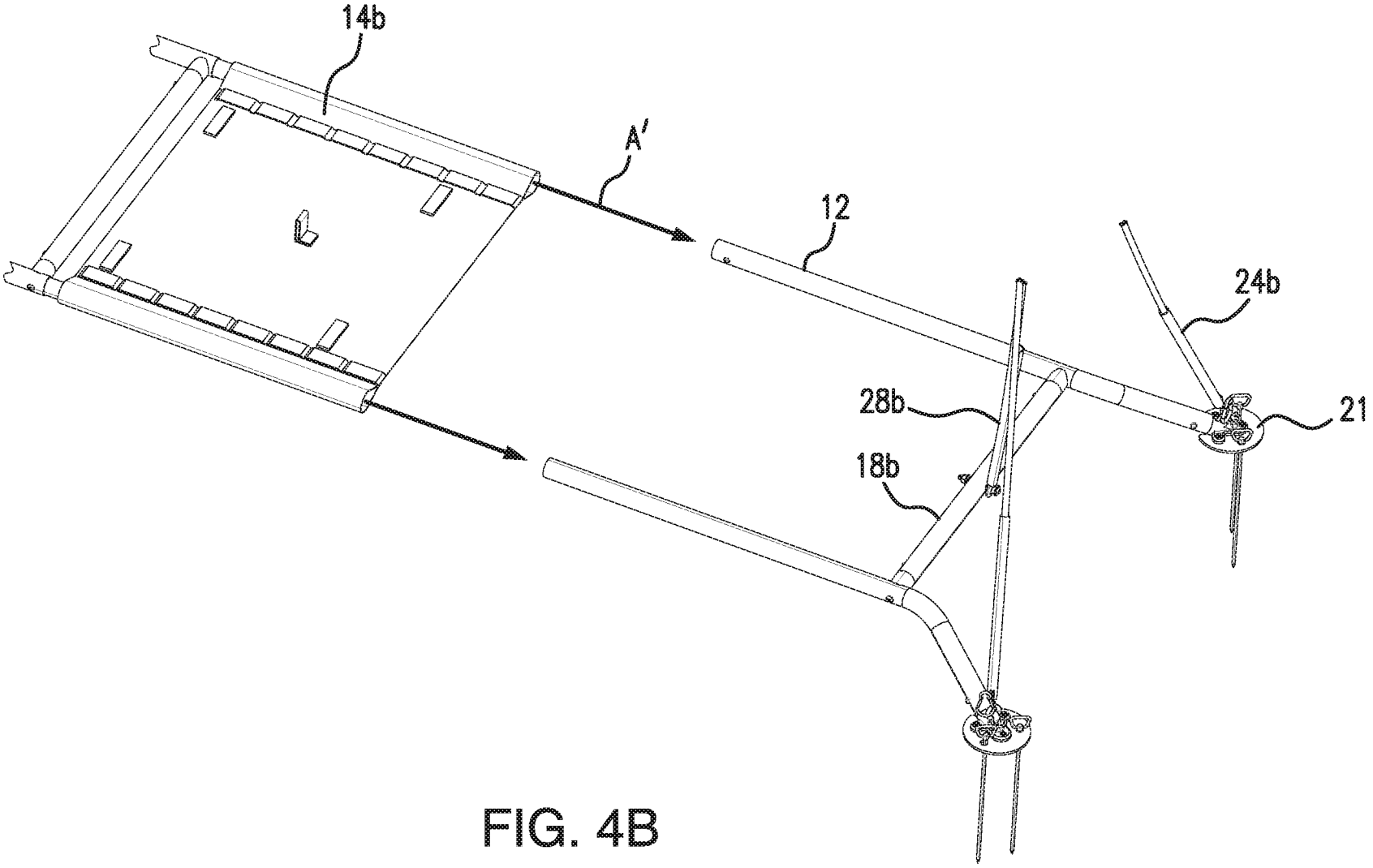
FIG. 4B is a perspective view of a second side of a base frame of the outdoor display system according to an embodiment.

Referring now to FIGS. 4A and 4B, there is a first side portion of a base frame 10 of the outdoor display system 44 according to an embodiment. In certain embodiments, the stretcher-style base includes rods 12, legs 22, crossbeam rod 18*a*, 18*b*, legs 22 and feet 21. Rods 24*a* and 28*a* are configured to connect to feet 21 and crossbeam rod 18*a*, respectively. In some embodiments, a second side portion of base frame 10 rods 24*b* and 28*b* are configured to connect to feet 21 and crossbeam rod 18*b*, respectively. In certain embodiments, anchor holders 14*a*, 14*b* are configured to span across crossbeam rods 18*a*, 18*b* and slidingly fit over rods 12 as shown by arrows A, A' in FIGS. 4A and 4B, respectively.

Figure 5A:
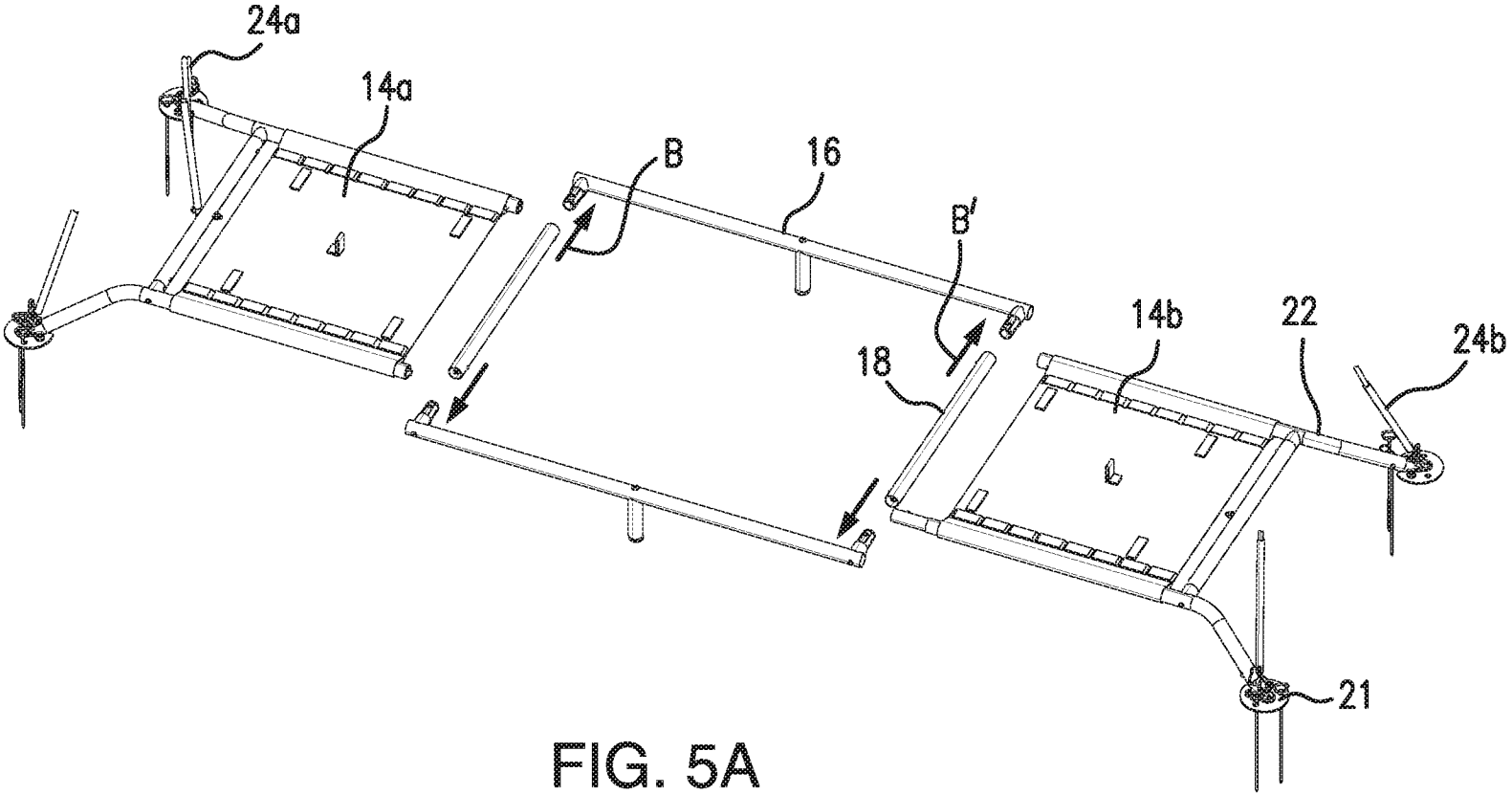
FIG. 5A is a perspective view of a center portion assembly of a base frame of the outdoor display system according to FIGS. 4A and 4B.
Figure 5B:
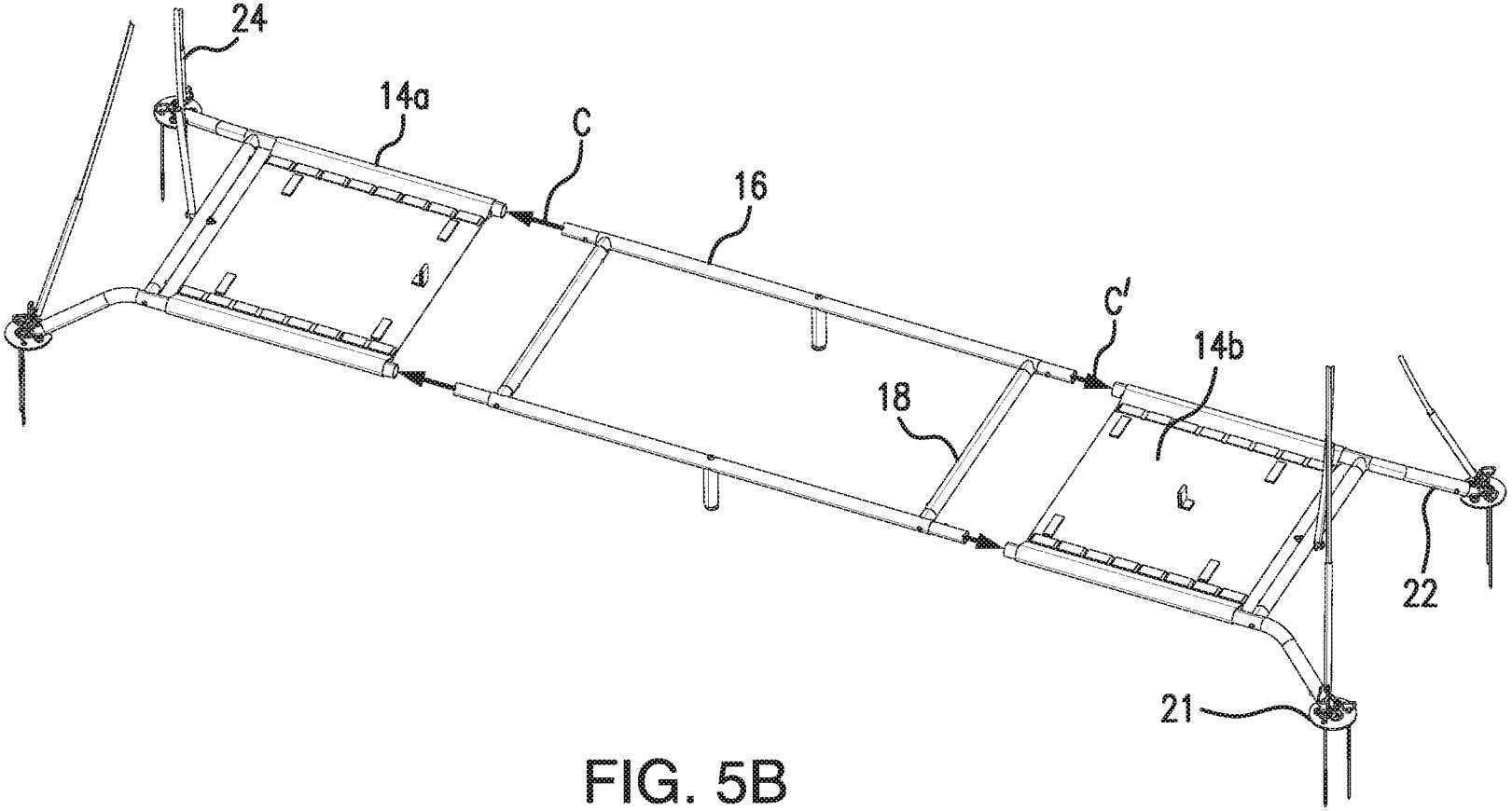
FIG. 5B is a perspective view of the center portion assembled of a base frame of the outdoor display system according to FIGS. 4A and 4B.

Referring now to FIGS. 5A and 5B, there is a center portion assembly at 16 of a base frame 10 of the outdoor display system 44 according to FIGS. 4A and 4B. In certain embodiments, the stretcher-style base includes three portions to be connected together via connectors as shown in FIGS. 3A and 3B discussed above. Center portion assembly at 16 is configured to connect to crossbeams 18 via connectors 19 as shown in FIG. 3B via arrows B, B'. Further, center portion assembly at 16 is also configured to connect to rods 12 via connectors 17 as shown in FIG. 3A via arrows C, C'.

Figure 6:
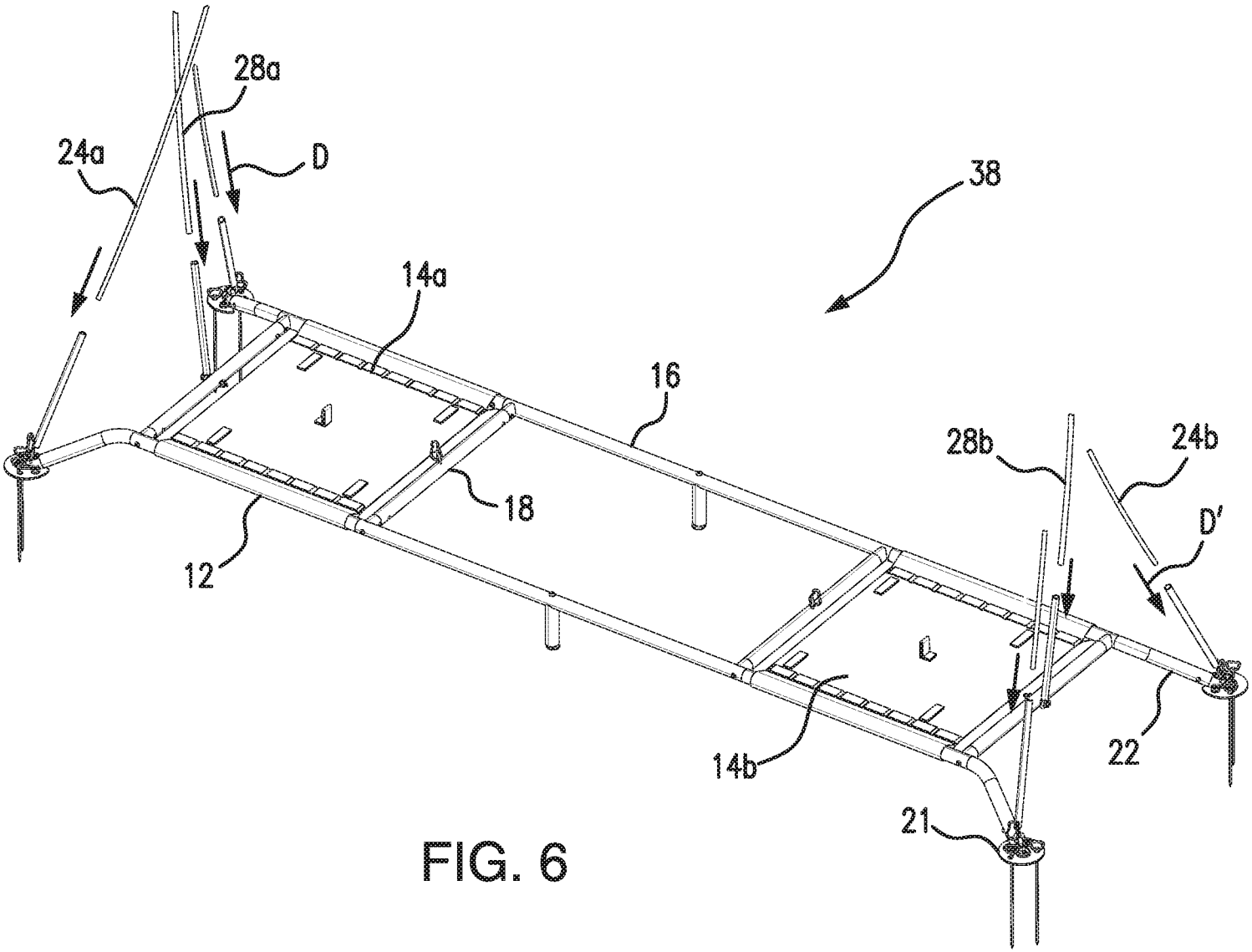
FIG. 6 is an exploded view of a lower frame assembly of the outdoor display system according to an embodiment.

Referring now to FIG. 6, there is a lower frame assembly 38 of the outdoor display system 44 according to an embodiment. In some embodiments, the rods 24*a*, 24*b*, 28*a*, 28*b* are configured to slidingly attach to feet 21 and crossbeams 18*c*, 18*d*, respectively via arrows D, D'.

Figure 7:
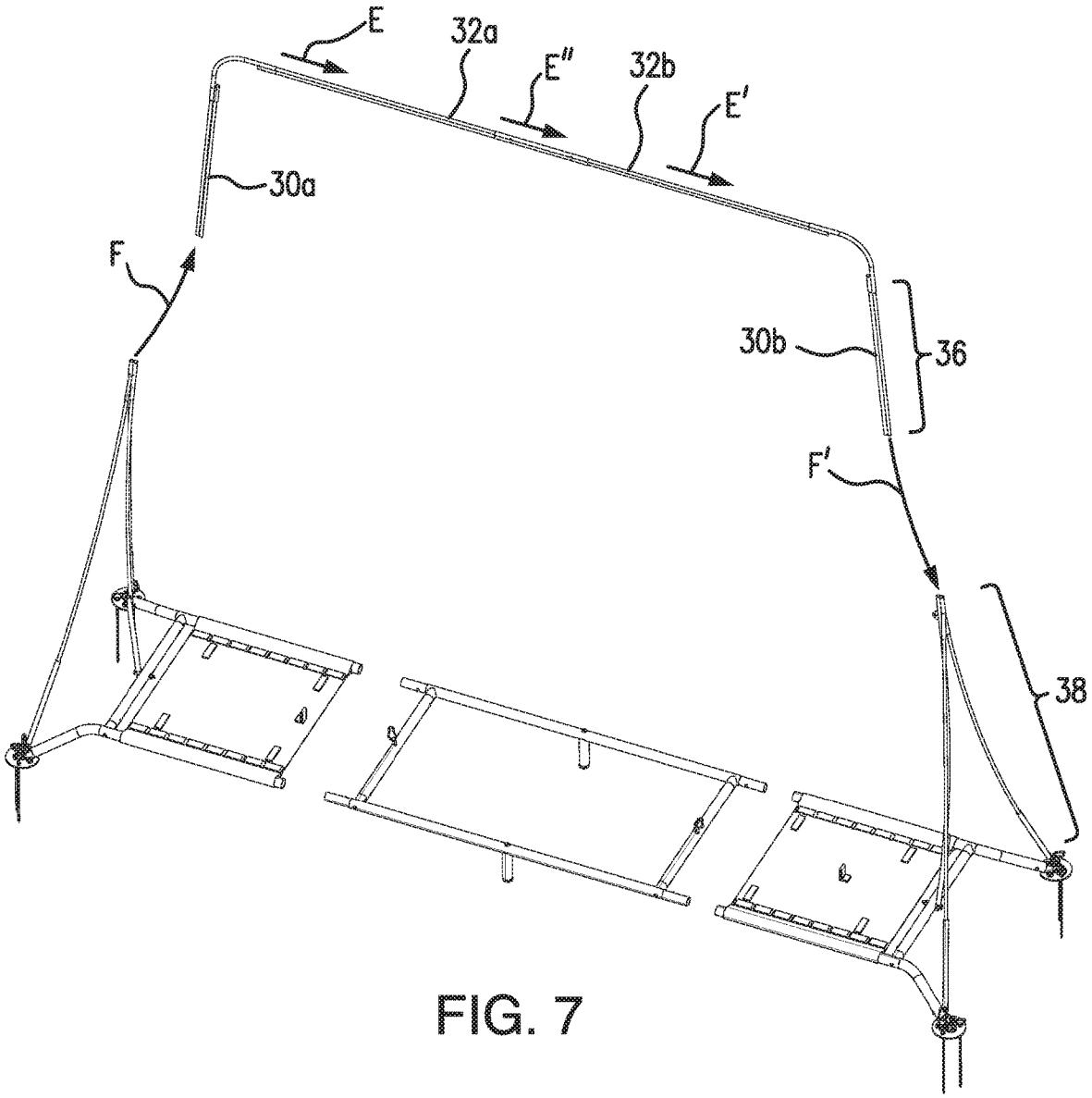
FIG. 7 is an exploded view of an upper frame assembly of the outdoor display system according to an embodiment.

Referring now to FIG. 7, there is an upper frame assembly 36 of the outdoor display system 44 according to an embodiment. In certain embodiments, the rods 30*a*, 30*b*, 32*a*, 32*b* are configured to slidingly attach to each other as indicated by arrows E, E', E". It should be noted that upper frame assembly 36 is configured to connect to lower frame assembly 38 via arrows F, F'. When the assembly of all components as shown in complete, stresses imparted by resilient forces resulting from bending the various members help make the entire skeleton or frame rigid but resilient so it can bend with the wind but return to its original shape when the wind loading is removed or reduced.

Figure 8:
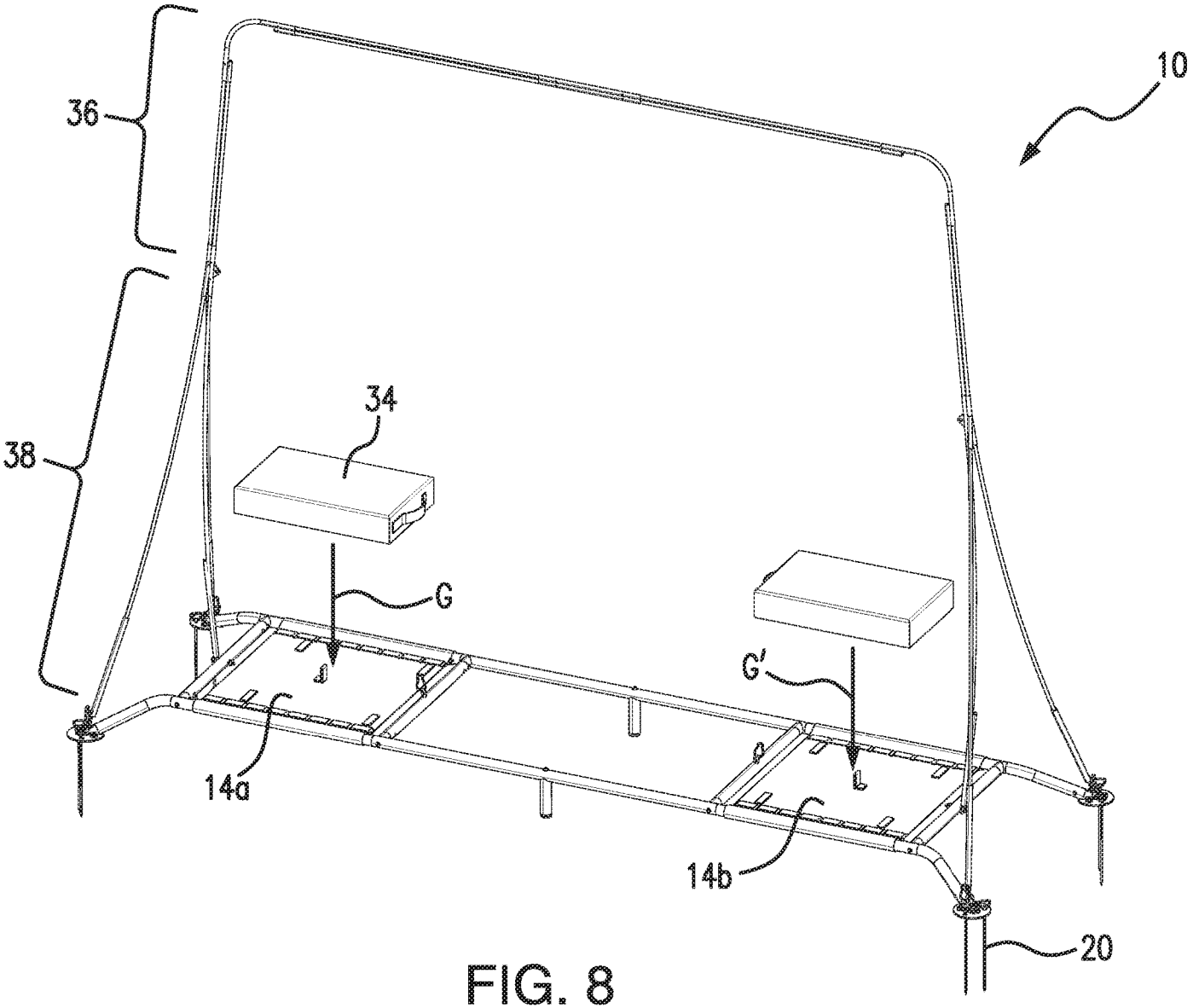
FIG. 8 is a perspective view of weighted anchors disposed on the first and second sides of a base frame of the outdoor display system according to an embodiment.

Referring now to FIG. 8, there are weighted anchors 34 disposed on the first and the second sides of a base frame 10 of the outdoor display system 44 according to an embodiment. In certain embodiments, anchors 34 may comprise of water, sand or other weights to anchor the frame 10 to the ground or its desired positioning. Anchors 34 may be placed on anchor holders 14*a*, 14*b* as shown via arrows G, G' for stabilization of frame 10. In some embodiments, stakes 20 may be used as well to hold feet 21 securely in place on the ground. In one embodiment, the anchors may include lighting and batteries to operate the lighting integrated therewith.

Figure 9A:
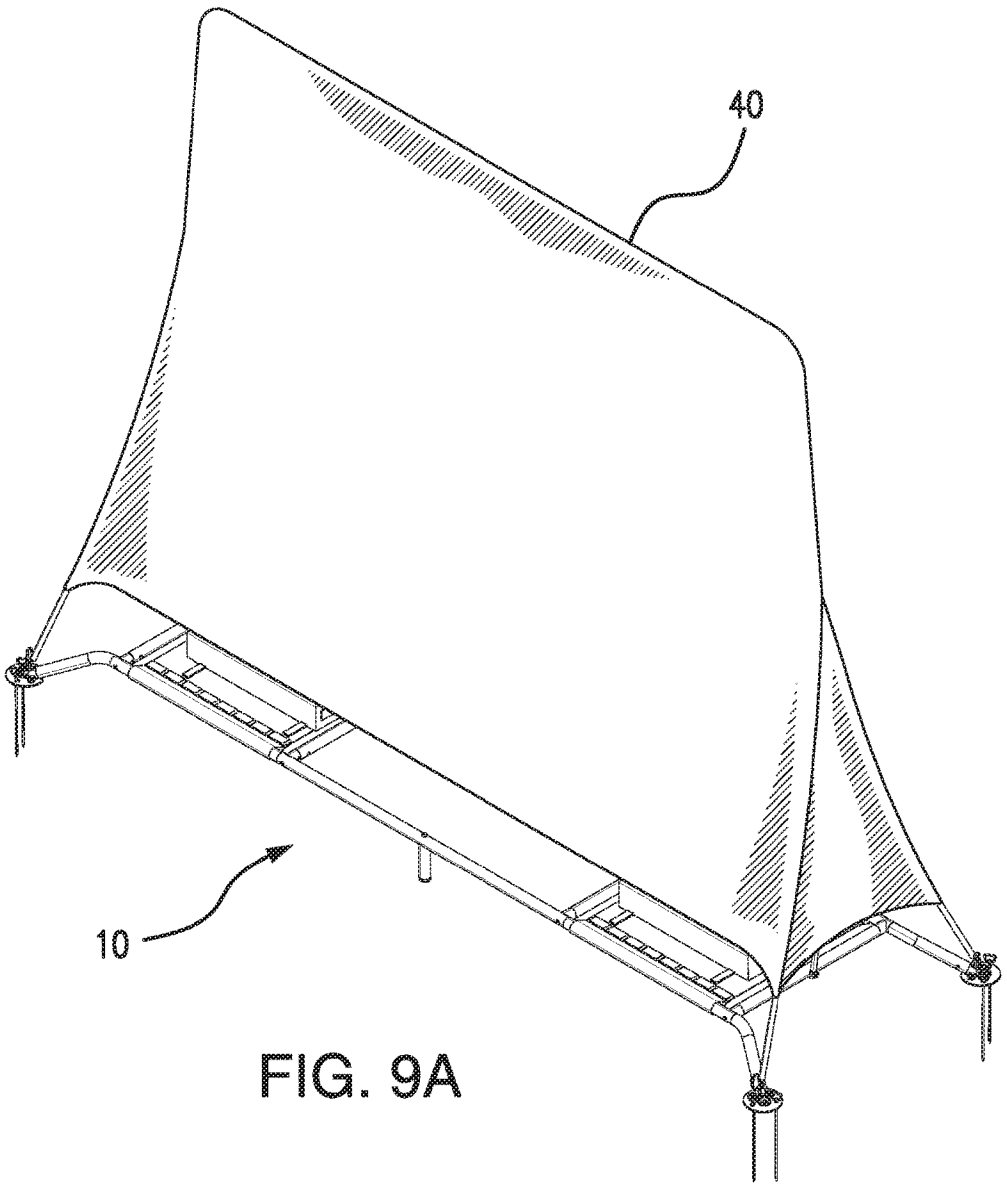
FIG. 9A is a perspective view of a fabric graphic cover mounted over the support frame of the outdoor display system according to an embodiment.

Referring now to FIG. 9A, there is a fabric graphic cover 40 mounted over the support frame 10 of the outdoor display system 44 according to an embodiment. In certain embodiments, an outdoor display system 44 includes a framed structure 10 that can be assembled and stand freely without being attached to any permanent structures. To display any graphics or information at 40. The structure 10 can then be disassembled for storage and transport. In some embodiments, the outdoor display system 44 is a billboard display. In some embodiments, a graphic fabric material 40 may be threaded with holes or openings to allow wind passing through all the while having a large clean display area for graphic images.

Figure 9B:
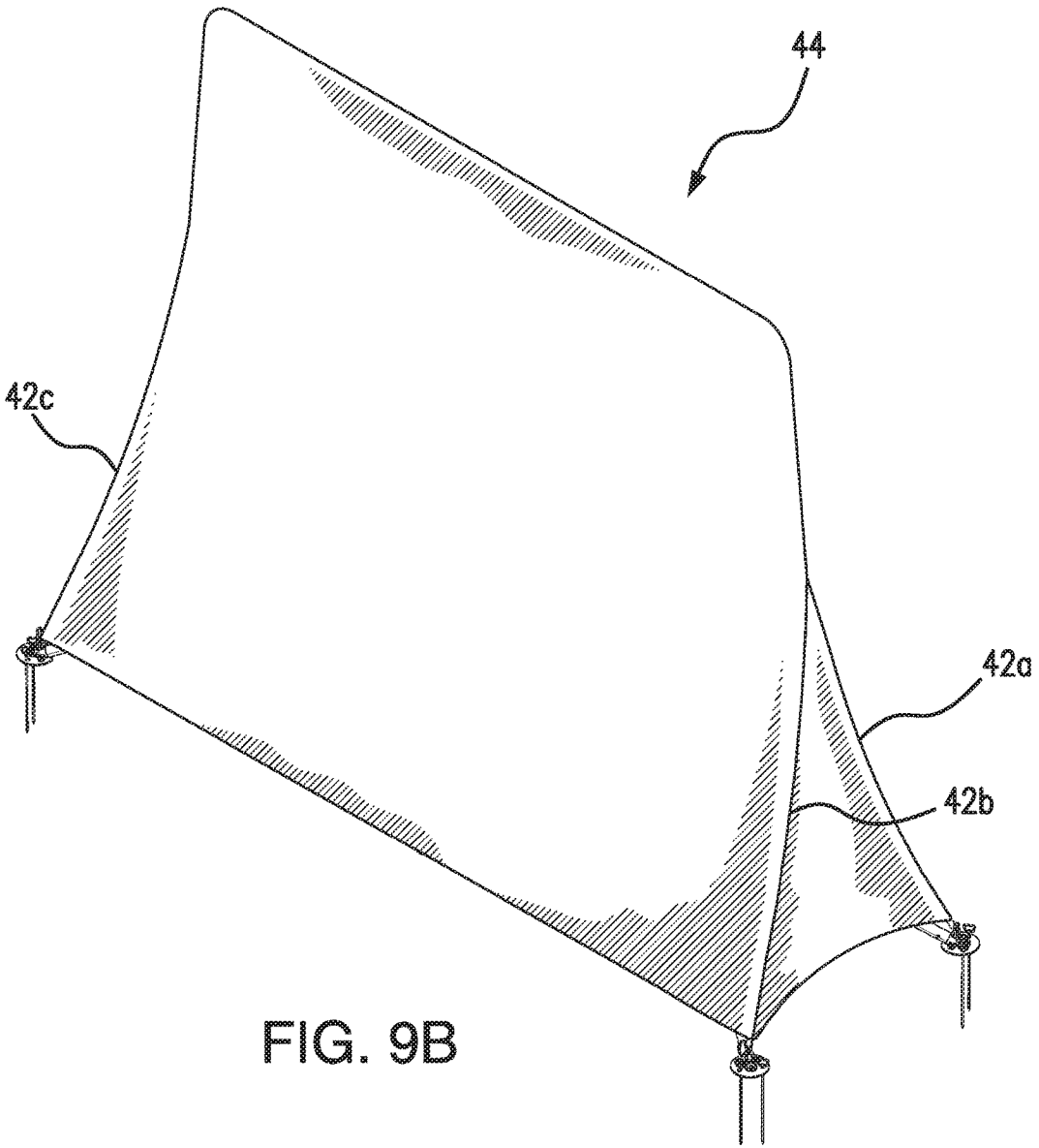
FIG. 9B is a perspective view of the assembled outdoor display system according to an embodiment.

Referring now to FIG. 9B, there is a perspective view of the assembled outdoor display system 44 according to an embodiment. Shape and size of the structure 10 allows for large surface area coverage of a graphic 44 while the structure 10 is freestanding. Wind resistant graphic material 40 having air openings (not shown) will also allow for better air flow and wind resistance.

Figure 10:
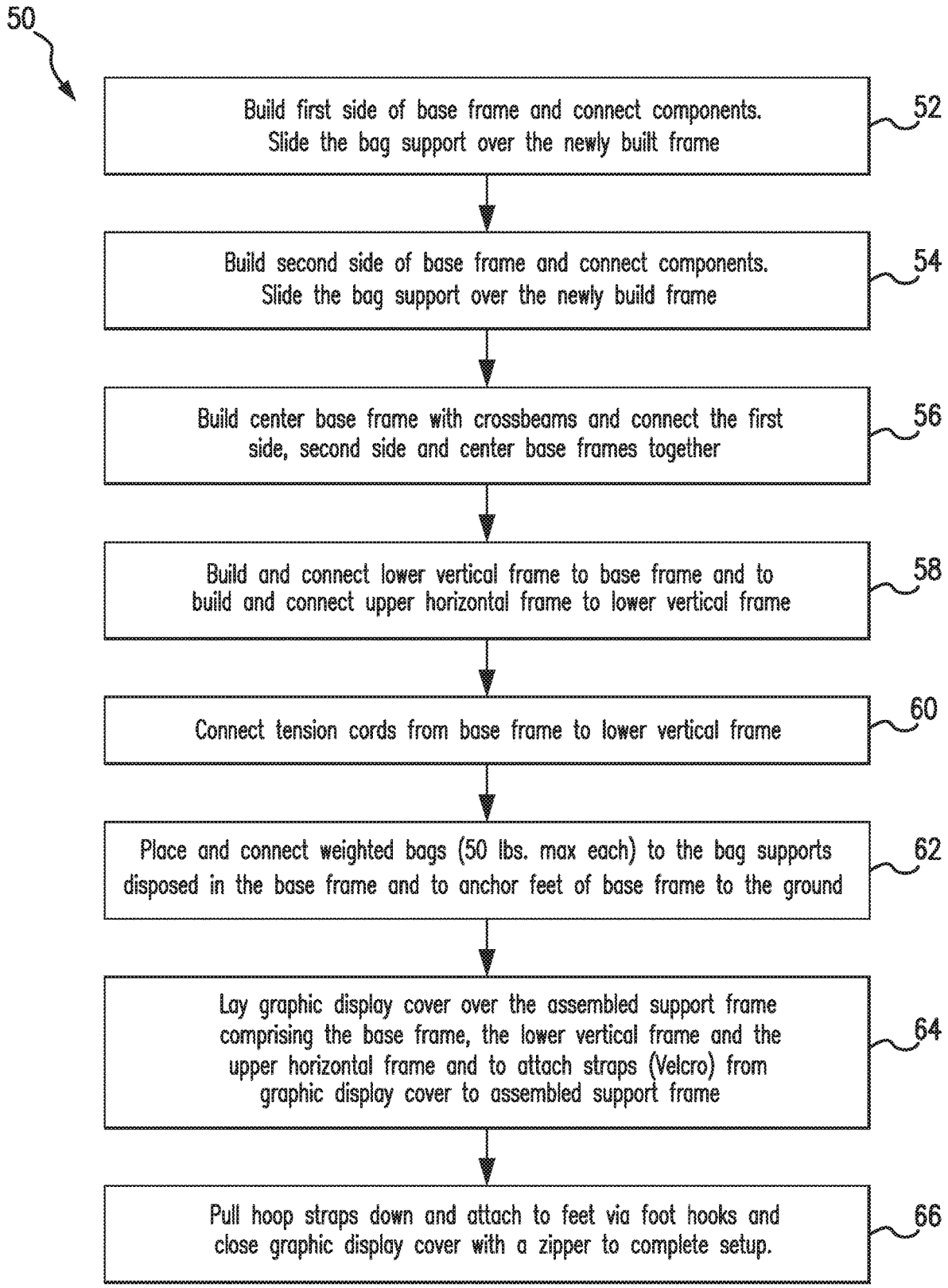
FIG. 10 is a flowchart illustrating a method of assembling the outdoor display system according to an embodiment.

Referring now to FIG. 10, there is a flowchart illustrating a method 50 of assembling the outdoor display system 44 according to an embodiment. In certain embodiments, the method 50 includes at 52 to build first side of base frame and connect components. Slide the bag support over the newly built frame. At 54, method 50 includes to build second side of base frame and connect components. Slide the bag support over the newly build frame. At 56, method 50 includes to build center base frame with crossbeams and to connect the first side, second side and center base frames together. At 58, method 50 includes to build and connect lower vertical frame to base frame and to build and connect upper horizontal frame to lower vertical frame. At 60, method 50 includes to connect tension cords from base frame to lower vertical frame. At 62, method 50 includes to place and connect weighted bags (50 lbs. max each) to the bag supports disposed in the base frame and to anchor feet of base frame to the ground. At 64, method 50 includes to lay graphic display cover over the assembled support frame comprising the base frame, the lower vertical frame and the upper horizontal frame and to attach straps (Velcro) from graphic display cover to assembled support frame. At 66, method 50 includes once graphic display cover is in place, to pull hoop straps down and attach to feet via foot hooks and close graphic display cover with a zipper to complete setup.

All references, including publications, patent applications, and patents, cited herein are hereby incorporated by reference to the same extent as if each reference were individually and specifically indicated to be incorporated by reference and were set forth in its entirety herein.

The use of the terms "a" and "an" and "the" and "at least one" and similar referents in the context of describing the invention (especially in the context of the following claims) are to be construed to cover both the singular and the plural, unless otherwise indicated herein or clearly contradicted by context. The use of the term "at least one" followed by a list of one or more items (for example, "at least one of A and B") is to be construed to mean one item selected from the listed items (A or B) or any combination of two or more of the listed items (A and B), unless otherwise indicated herein or clearly contradicted by context. The terms "comprising," "having," "including," and "containing" are to be construed as open-ended terms (i.e., meaning "including, but not limited to,") unless otherwise noted. Recitation of ranges of values herein are merely intended to serve as a shorthand method of referring individually to each separate value falling within the range, unless otherwise indicated herein, and each separate value is incorporated into the specification as if it were individually recited herein. All methods described herein can be performed in any suitable order unless otherwise indicated herein or otherwise clearly contradicted by context. The use of any and all examples, or exemplary language (e.g., "such as") provided herein, is intended merely to better illuminate the invention and does not pose a limitation on the scope of the invention unless otherwise claimed. No language in the specification should be construed as indicating any non-claimed element as essential to the practice of the invention.

Preferred embodiments of this invention are described herein, including the best mode known to the inventors for carrying out the invention. Variations of those preferred embodiments may become apparent to those of ordinary skill in the art upon reading the foregoing description. The inventors expect skilled artisans to employ such variations as appropriate, and the inventors intend for the invention to be practiced otherwise than as specifically described herein. Accordingly, this invention includes all modifications and equivalents of the subject matter recited in the claims appended hereto as permitted by applicable law. Moreover, any combination of the above-described elements in all possible variations thereof is encompassed by the invention unless otherwise indicated herein or otherwise clearly contradicted by context.

The invention claimed is:

1. A display system, comprising:

a base frame comprising:

a first side portion comprising a first plurality of rods;

a first bag support slidably disposed over the first side portion of the base frame;

a second side portion comprising a second plurality of rods;

a second bag support slidably disposed over the second side portion of the base frame;

a center portion including crossbeams;

the first side portion connected to the center portion, the second side portion connected to the center portion opposite the first side portion to form the base frame into a stretcher;

a lower vertical frame connected to the base frame, the lower vertical frame comprising a first pair of support rods forming a generally triangular configuration at a first end of the stretcher and a second pair of support rods forming a generally triangular configuration at a second end of the stretcher, the first end being disposed opposite the second end along the stretcher;

an upper horizontal frame connected to upper ends of the first and second pairs of support rods of the lower vertical frame;

a first tension line attached to the lower vertical frame adjacent the upper end of the first pair of support rods and to the base frame inboard of the first pair of support rods and a second tension line attached to the upper horizontal frame adjacent the upper end of the second pair of support rods and the base frame inboard of the second pair of support rods; and a graphic display cover removably disposed on the upper support frame and shaped and sized to widen over the lower support frame;

wherein the upper support frame, the lower support frame and the base frame are collapsible and transportable.

2. The system of claim 1, wherein the base frame comprises aluminum.

3. The system of claim 1, wherein the graphic display cover is porous to allow air to pass therethrough.

4. The system of claim 1, wherein the base frame includes support legs, each of the support legs connected to and extending from one of the corners of the stretcher, and an anchored foot attached to a distal end of each of the support legs.

5. The system of claim 1, wherein the base frame includes a plurality of spring-loaded connectors configured to permit collapse of the base frame.

6. The system of claim 1, wherein the graphic display cover is configured to slidingly fit over the upper horizontal frame, the lower vertical frame and the base frame.

7. The system of claim 1, wherein the upper horizontal frame comprises a plurality of flexible rods.

8. The system of claim 7, wherein the flexible rods comprise fiberglass.

9. The system of claim 1, wherein the upper horizontal and lower vertical frames form an elongate pyramidal shape when assembled to the base frame.

10. A method of assembly of an outdoor display, comprising:

building a first side portion of a base frame via connecting a first plurality of rods;

sliding a first bag support over the first side of the base frame;

building a second side portion of the base frame via connecting a second plurality of rods;

sliding a second bag support over the second side of the base frame;

building a center portion of the base frame including crossbeams;

connecting the first side, second side and center portions to form the base frame into a stretcher;

building and connecting a lower vertical frame to the base frame, the lower vertical frame comprising a first pair of support rods forming a generally triangular configuration at a first end of the stretcher and a second pair of support rods forming a generally triangular configuration at a second end of the stretcher, the first end opposite the second end;

building an upper horizontal frame and connecting the upper horizontal frame to upper ends of the first and second pairs of support rods of the lower vertical frame, and attaching a first tension line to the lower vertical frame adjacent the upper end of the first pair of support rods and to the base frame inboard of the first pair of support rods and attaching a second tension line to the upper horizontal frame adjacent the upper end of the second pair of support rods and the base frame inboard of the second pair of support rods;

wherein the base frame is anchored to the ground at multiple locations about the base frame, and wherein the upper horizontal frame, the lower vertical frame and the base frame are collapsible and transportable.

11. The method of claim 10, further comprising:

placing and connecting a plurality of weighted bags to the first and second bag supports disposed in the base frame.

12. The method of claim 10, further comprising:

anchoring a plurality of anchor feet of the base frame to ground to anchor the base frame; and sliding a graphic display cover over the assembled support frame comprising the base frame, the lower vertical frame and the upper horizontal frame.

13. The method of claim 12, wherein the graphic display cover is a porous printable fabric to allow air to pass therethrough.

14. The method of claim 10, wherein the base frame comprises aluminum.

15. The method of claim 10, wherein the base frame includes a plurality of spring-loaded connectors comprised of zinc plating.

16. The method of claim 10, wherein the upper horizontal frame comprises a plurality of flexible rods.

17. The method of claim 16, wherein the plurality of flexible rods comprise fiberglass.

* * * * *